United States Patent [19]

Bell

[11] Patent Number: 4,692,580

[45] Date of Patent: Sep. 8, 1987

[54] MICROWAVE OVEN WARNING DEVICE

[76] Inventor: Ronald D. L. Bell, 28 Keewatin Crescent, Nepean, Ontario, Canada, K2E 6Z1

[21] Appl. No.: 851,945

[22] Filed: Apr. 14, 1986

[51] Int. Cl.[4] ..... H05B 6/80

[52] U.S. Cl. ..... 219/10.55 M; 219/10.55 R; 219/10.55 E; 324/96; 99/DIG. 14

[58] Field of Search ..... 219/10.55 R, 10.55 E, 219/10.55 F, 10.55 D, 10.55 M; 324/96; 126/388; 99/344, DIG. 14

[56] References Cited

U.S. PATENT DOCUMENTS

| | | | |
|---|---|---|---|
| 2,630,776 | 3/1953 | Lewis | 126/388 X |
| 3,316,380 | 4/1967 | Pansing | 219/10.55 F |
| 3,916,818 | 11/1975 | Barr et al. | 126/388 X |
| 4,345,512 | 8/1982 | Moore | 219/10.55 E X |
| 4,381,439 | 4/1983 | Miyazawa et al. | 219/10.55 R X |
| 4,406,860 | 9/1983 | Beauvais et al. | 219/10.55 E X |
| 4,418,637 | 12/1983 | Heermans | 126/388 X |
| 4,490,597 | 12/1984 | Mengel | 219/10.55 E |
| 4,529,855 | 7/1985 | Fleck | 219/10.55 D |
| 4,539,454 | 9/1985 | Yangas | 219/10.55 F |

*Primary Examiner*—Philip H. Leung
*Attorney, Agent, or Firm*—Krass & Young

[57] ABSTRACT

Microwave cooking has become very popular and microwave cooking ovens are being sold in large numbers. The manufacturers of microwave ovens warn purchasers not to operate the microwave oven when the oven is empty. Operating the oven empty can result in damage to the magnetron tube and start a fire. The device of this invention is placed in the microwave oven while the oven is not in use and if the oven is accidentally turned on, the warning device will sound an alarm and warn the operator.

1 Claim, 1 Drawing Figure

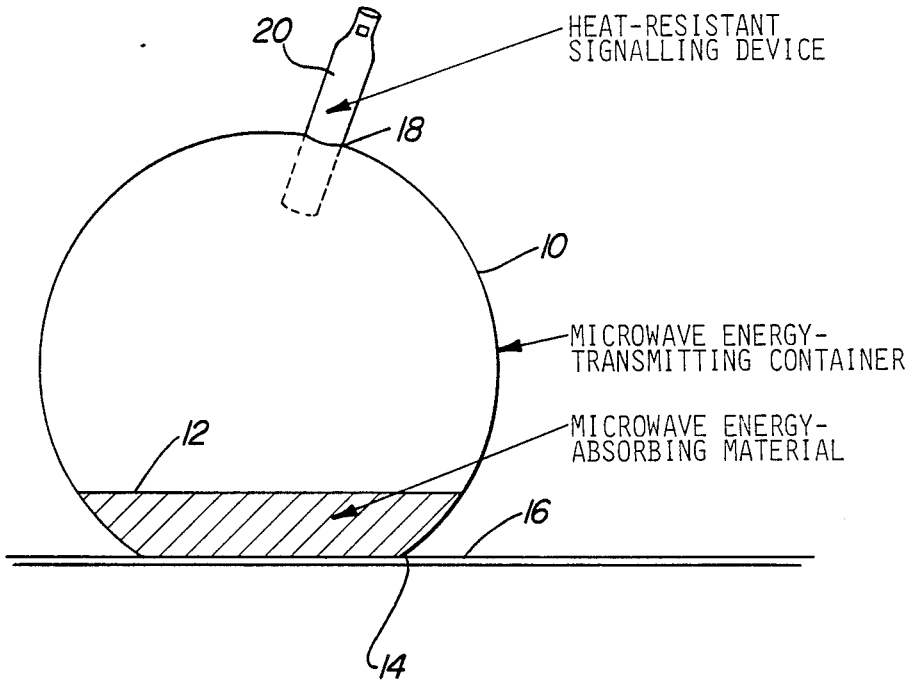
20
HEAT-RESISTANT SIGNALLING DEVICE
18
10
MICROWAVE ENERGY-TRANSMITTING CONTAINER
12
MICROWAVE ENERGY-ABSORBING MATERIAL
16
14

MICROWAVE OVEN WARNING DEVICE

FIELD OF THE INVENTION

This invention relates to a warning device to protect the microwave oven from being damaged by the accidental operation of the oven while it is empty and to signal to the operator that the oven should be turned off.

BACKGROUND OF THE INVENTION

Microwave cooking has become very popular and its use will continue to increase. The concept of microwave cooking is that within an enclosed oven, a magnetron tube generates microwave energy, a form of high frequency radio wave energy, and cooks by exciting the molecules, particularly water, comprising the food. The manufacturers of microwave ovens warn purchasers not to operate the oven without any material in the oven. Operating the oven when it is empty can result in the magnetron tube being damaged by reabsorbing the microwave energy. The damage can occur in a relatively short period of time. Depending on the model of machine, control setting and other factors, the magnetron tube can be permanently damaged in 12 to 15 minutes. The magnetron tube is one of the more expensive components of the microwave oven. It is also possible that the microwave oven could catch fire if the magnetron tube overheated.

The various models of microwave ovens have different operational controls. Generally, the more expensive the model, the more sophisticated the operational controls. The more basic models can be accidentally started without food or other material in the oven. Some models provide for a time period to cook food. If food is removed from the oven prior to the expiration of the time period and the time is not reset to zero, the magnetron tube can be reactivated simply by accidentally pushing the restart button. It is also possible that children can start the cooking cycle by pushing the operational controls in the proper sequence. It is advisable to place a cup of water in the oven at all times that the oven is not being used.

With respect to microwave energy, materials are absorbers, transmitters or reflectors. The molecular structure of foods, particularly the water component, are good absorbers of microwave energy. This is why food cooks so readily. Materials, such as glass, paper, china and some plastics have a molecular structure that allows microwave energy to be transmitted throughout the material without affecting the material or the energy. This characteristic of these materials makes them excellent cooking utensils for microwave ovens. Metals neither absorb nor transmit microwave energy but reflect it. Metals are used in the walls, door and some other components of the microwave oven to reflect the microwave energy for proper heating of the food.

SUMMARY OF THE INVENTION

This invention is a warning device to protect the microwave oven from being damaged by the accidental operation of the oven while it is empty and to signal to the operator that the oven should be turned off. The warning device is composed of a container with an orifice comprised of microwave energy transmitting material in said container, partially filled with a microwave energy absorbing substance and the container sealed at the orifice with a heat resistant vapor activated signalling device.

The microwave energy transmitting materials that can be used for the container are heat resistant glass, glass ceramic, china and microwave safe plastics. To resist breakage, the preferred material is microwave safe plastics.

If the warning device operated long enough without the oven being turned off, eventually the microwave absorbing substance in the container would completely vaporize and the vapor would escape through the oven vents. Once the warning device was completely empty the oven could still be damaged by the microwave energy and possibly start a fire. A preferred embodiment of this invention is where the container is filled with a sufficient amount of microwave energy absorbing substance to activate the signalling device within 2 to 4 minutes of accidental operation of the microwave oven. However, there should also be sufficient microwave energy absorbing substance to absorb the microwave energy for up to 10 minutes, to prevent loss of all substance before the operator becomes aware of the situation. The ratio between the size of the container and the amount of microwave energy absorbing substance should range between 4:1 and 2.5:1 although other ratios can be used providing they activate the signalling device quickly and provide a sufficient period of protection until the microwave oven is turned off.

The container can be any size that will fit in the microwave oven. However, a container between 100 and 2000 milliliters in size is preferred with a container 250 milliliters, a size being most convenient.

The microwave energy absorbing substance used in the container can be any substance that absorbs microwave energy and produces a vapor to activate the signalling device. Substances to be avoided are any substances that are flammable, explosive, corrosive, toxic, contain toxic components, or form toxic components on heating. Substances that would stain or discolor the microwave oven if released on operation of the signalling device must also be avoided. The substance must also be stable for long periods of time at ambient room temperature and conditions. The preferred substance is sterilized distilled water, although water, sterilized water or distilled water can be used.

The signalling device can be any means that will sound an alarm when vapor or steam is passed through the device. The signalling device must be able to withstand the temperature of the vapor or steam without deforming or losing its integrity. The signalling device must also make a sound sufficiently loud enough to be heard by the operator in the vicinity of the closed microwave oven. The preferred warning device is a whistle.

The invention is placed in the oven by the operator at all times when the oven is not being used for cooking or other normal use. In the event the oven is accidentally switched on, the microwave energy absorbing substance will absorb the energy preventing damage to the magnetron tube. The microwave energy absorbing substance will vaporize on heating and create a positive pressure in the container. This positive pressure will force open the seal in the orifice and activate the signalling device. The sound from the signalling device will warn the operator and the microwave oven can be shut off before any damage occurs. Thus, this invention protects the microwave oven during the period that the microwave oven is accidentally operating and warns the operator to turn the microwave off.

BRIEF DESCRIPTION OF THE DRAWING

The FIGURE is a sectional plan view of the microwave warning device comprising the preferred embodiment of my invention.

DETAILED DESCRIPTION OF THE PREFERRED EMBODIMENT

Referring to the FIGURE, a warning device adapted to be inserted into a microwave oven, whenever the oven is empty, comprises a spherical container 10, preferably formed of glass, china or plastic having a microwave transmitting characteristic and an interior volume of about 250 milliliters. Approximately 75 milliliters of water 12, which is preferably distilled water, is supported within the container 10. The container has a flat base portion 14 which allows it to be supported on a flat surface such as a shelf 16 within a microwave oven.

The container 10 is sealed except for an orifice 18 which is closed off by a conventional whistle 20. The whistle projects through the orifice 18 and the edges of the orifice are sealed to the outer section of the whistle.

In use, the container 10 is disposed on a shelf 16 within a microwave oven so that the whistle projects upwardly. If the microwave oven is accidentally turned on, the water 12 will be heated. When it begins to vaporize, the vapor will be forced through the whistle 20 to generate an audible signal of sufficient intensity to be heard outside the closed microwave oven. Depending upon the power level at which the microwave oven is operated, the audible whistle may be generated within 2–4 minutes after the oven is energized. Vapor will continue to be generated for at least 10 minutes before the water is fully boiled away. During that period of time, absorption of microwave enegy by the water will prevent any damage to the magnetron tube.

Although the invention is described with respect to the preferred embodiment and modifications, the details thereof are not to be construed as limitations except to the extent indicated in the following claims.

I claim:

1. A process for preventing damage to a microwave oven comprising the steps of:

providing a device which is operative in response to receipt of microwave energy to absorb the microwave energy for a predetermined period of time and also generate a warning signal; and placing the warning device in the empty microwave oven when the oven is not in use so that in the event of accidental or unintended switching on of the oven the warning device operates to absorb the microwave energy for said predetermined period of time to avoid damage to the oven for said predetermined period of time and also operates to produce a warning sound to alert the operator that the oven is operating so that the oven may be turned off to avoid damage to the oven beyond said predetermined period of time.

* * * * *